US008683836B2

(12) United States Patent
Golovashchenko

(10) Patent No.: US 8,683,836 B2
(45) Date of Patent: Apr. 1, 2014

(54) METHOD AND APPARATUS FOR FORMING SHARP STYLING LINES ON METAL PANELS

(75) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 311 days.

(21) Appl. No.: 13/194,181

(22) Filed: Jul. 29, 2011

(65) Prior Publication Data

US 2013/0025343 A1 Jan. 31, 2013

(51) Int. Cl.
*B21D 28/18* (2006.01)
*B21D 31/02* (2006.01)

(52) U.S. Cl.
USPC ..... 72/57; 72/60; 72/466.7; 72/466.8; 72/465.1

(58) Field of Classification Search
USPC ..... 72/54, 55, 56, 57, 60, 63, 466.7, 466.8, 72/465.1
See application file for complete search history.

(56) References Cited

U.S. PATENT DOCUMENTS

| | | | | | |
|---|---|---|---|---|---|
| 2,317,869 | A * | 4/1943 | Walton | 72/57 |
| 2,749,867 | A * | 6/1956 | Engel | 72/60 |
| 2,783,728 | A * | 3/1957 | Hoffmann | 72/57 |
| 3,276,239 | A * | 10/1966 | Achler et al. | 72/57 |
| 3,594,963 | A * | 7/1971 | Beasley | 51/293 |
| 3,760,622 | A * | 9/1973 | Mansell | 72/57 |
| 3,986,379 | A * | 10/1976 | Mansell | 72/57 |
| 4,574,445 | A * | 3/1986 | Bentin et al. | 29/890.1 |
| 5,490,407 | A * | 2/1996 | Doose | 72/57 |
| 6,233,989 | B1 * | 5/2001 | Blinstrubas | 72/55 |
| 6,938,449 | B2 * | 9/2005 | Kusunoki et al. | 72/57 |
| 6,952,941 | B2 | 10/2005 | Friedman et al. | |
| 7,467,532 | B2 | 12/2008 | Golovashchenko | |

* cited by examiner

*Primary Examiner* — David B Jones
(74) *Attorney, Agent, or Firm* — Damian Porcari; Brooks Kushman P.C.

(57) ABSTRACT

An apparatus and method for forming a style line with a sharp radius in a metal with lower formability than that of mild steel is disclosed. The apparatus and method use a die set with a means to back a portion of the metal having the style line formed with a material that moves with the surface of the style line as it is formed. In one embodiment an elastic member backs the metal panel, and in another embodiment a fluid medium backs the metal panel where the style line is formed. The apparatus and method achieve sharper radius style lines in metals like aluminum, advanced high strength steel, and ultra-high strength steel than a traditional hard surface die set can achieve.

20 Claims, 3 Drawing Sheets

METHOD AND APPARATUS FOR FORMING SHARP STYLING LINES ON METAL PANELS

TECHNICAL FIELD

This disclosure relates to forming styling lines on metal panels.

BACKGROUND

Automotive body panels are formed in high volume production by a conventional process of stamping a sheet of mild steel between two stamping dies with matching hard surfaces. Vehicle manufacturers are reducing the use of mild steel sheet panels and converting to the use of aluminum, advanced high strength steel (AHSS), or ultra-high strength steel (UHSS). Aluminum, AHSS and UHSS offer high strength/low weight alternatives to mild steel, but have lower formability properties compared to mild steels. Lower formability properties limit the curvatures of styling lines and results in larger radius styling lines than corresponding styling lines on steel panels.

The following references were considered in conjunction with preparing this application: U.S. Pat. No. 6,952,941 B2 to Friedman et al. and U.S. Pat. No. 7,467,532 B2 to Golovashchenko.

SUMMARY

An apparatus is disclosed for forming a style line on a metal panel inserted between two dies. The apparatus has an elastic member held by one die and a forming edge opposite the elastic member protruding from the opposing die. When the dies close, the forming edge engages the metal panel to form the style line. During the forming of the style line, the portion of the metal panel having the style lined formed within is pushed into the elastic member. The forming edge plastically deforms the metal panel while elastically deforming the elastic member.

In some embodiments, the forming edge is on a tool insert disposed in a tool holder channel in the opposing die to be moveable relative to the dies. The moveable tool insert allows the dies to stamp other features of the part while allowing the tool insert to form the style line at a different rate, a different pressure, a different angle, or with a different extent of displacement than the dies.

In other embodiments, one die may define an aperture and the elastic member may be an insert elastic member disposed within the aperture to facilitate replacing the elastic member.

In another embodiment, a friction reducing coating may be provided on the elastic member to prolong the life of the elastic member and aid in forming the metal panel. The friction reducing coating minimizes undesirable results during forming caused by tangential motion of the metal panel relative to the elastic member. Tangential motion of the metal member relative to the elastic member creates friction that may damage the elastomer and cause flaws in the appearance of the metal member. The friction reducing coating minimizes adverse effects of the metal panel slipping tangentially during the forming of the style line.

In yet other embodiments, the thickness of the elastic member is at least twice the height of the style line in the forming direction. The thickness of the elastic member impacts how much compression is available within the elastic member. The thickness of the elastic member must be such as to be capable of elastically deforming to the dimensions of the style line of the metal panel when the style line is formed. The top of the style line may experience greater pressures than the bottom of the style line during forming if the thickness of the elastic member is too thin, thus resulting in a non-uniform pressure distribution.

In still other embodiments, the elastic member has a face surface substantially orthogonal to the movement of the forming edge during the forming of the style line. The substantially orthogonal face surface minimizes deflection of the tool relative to the elastic member minimizing the loss of force and equalizing the in pressure applied to the metal panel during forming.

In further embodiments, the elastic member is polyurethane having a 30 to 60 shore D durometer, and the forming edge has a leading edge radius between 0 and 2 t (two times the thickness of the metal panel).

In most embodiments, the apparatus is used with a metal panel that has lower formability limits than mild steel, such as an aluminum, AHSS or UHSS panel.

According to another aspect of the disclosure, a method is disclosed of forming a portion of a metal panel with a tool having a forming edge that advances into a portion of the metal panel that is backed by the elastic polymer member. The forming edge of the metal panel forms the style line compressing the elastic polymer member as the style line is formed.

According to other aspects of the disclosure, one surface of the metal panel maybe impressed with the same shape as the forming edge of the advancing tool as the style line forms. The elastic polymer member maintains contact with the metal panel, as the style line forms. The outer face of the elastic polymer member stretches at substantially the same rate as an outer surface of the metal member, as the style line forms.

In an alternative embodiment, a cavity containing a fluid medium may be used to back the metal panel while forming the style line. In this embodiment, the cavity is adjacent to a forming portion of the metal panel, and a forming tool pushes the forming portion of the metal panel into the cavity displacing the fluid medium as the forming tool advances into the metal panel. The fluid medium provides similar surface support to the metal panel to that of the elastic member in the previous embodiments.

In another aspect of the alternative embodiment, a sealing surface surrounds the cavity and in cooperation with the metal panel maintains the fluid medium within the cavity. The sealing surface contacts one surface of the metal panel as the dies close and provides a substantially leak-free void that is filled with the fluid medium. The seal may be designed to withstand the fluid medium under a higher pressure than ambient pressure. The fluid may be pumped out of the void before opening the dies and breaking the seal to provide a cleaner operating environment during manufacturing.

In yet another aspect of the alternative embodiment, a pressure source may be provided that is in fluid connection with the cavity. The pressure source may be used to maintain a substantially constant pressure, increase the pressure, or reduce the pressure exerted on the metal panel by the fluid medium during any point of the stamping operation.

DETAILED DESCRIPTION

Several detailed embodiments of the present invention are disclosed below. It should be understood that the disclosed embodiments are merely examples, and that the invention may be embodied in various and alternative forms. The figures are not necessarily to scale, and some features may be exaggerated or minimized to show details of particular components. The specific structural and functional details are not to be interpreted as limiting, but merely as a representative basis for teaching one skilled in the art how to practice the present invention.

Figure 1:
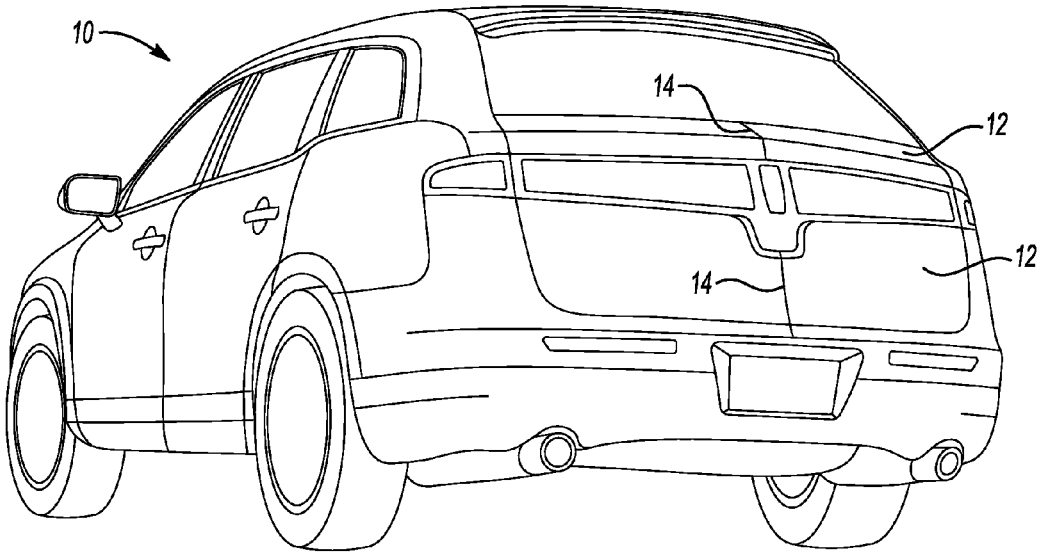
FIG. 1 is a rear perspective view of a vehicle showing a metal panel having a style line.

Referring to FIG. 1, an automobile 10 is shown with a metal panel 12 having a style line 14. The metal panel 12 is made from a higher strength or lighter weight material than mild steel, such as, but not limited to, aluminum, AHSS and UHSS. Metals such as aluminum, AHSS and UHSS have lower formability properties than that of mild steel. The illustrated style line 14 has a sharper bend radius than a traditional hard die set utilizing a single stamp operation is capable of producing.

Figure 2:
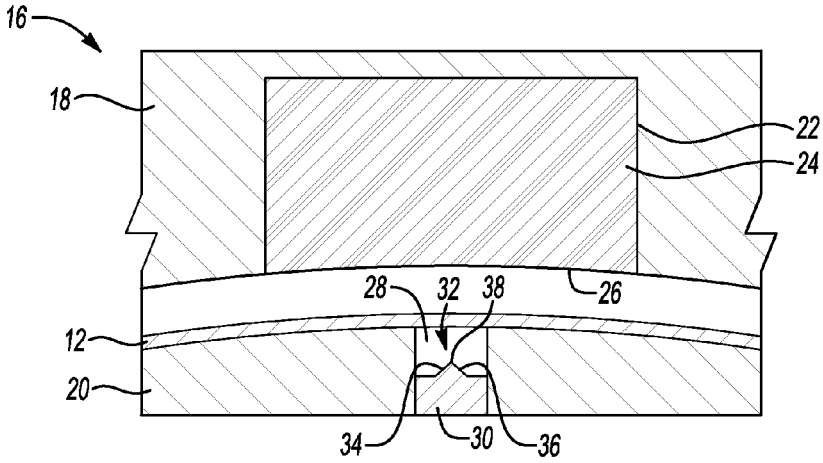
FIG. 2 is a cross-sectional view of the metal panel inserted between a first die and a second die, where the first die holds an elastic member, the second die holds a tool insert, and the first die and second die are open.

Referring to FIG. 2, a die set 16 is shown with the metal panel 12 disposed between a first die 18 and a second die 20 with the dies 18,20 in an open position. The first die 18 defines an aperture 22 and an elastic member 24 is disposed within the aperture 22. The elastic member 24 may be made from any material with elastic properties, but is preferably a polymer with a shore D durometer between 30 and 60. ASTM D2240-00 testing standard calls for a total of 12 scales, depending on the intended use; types A, B, C, D, DO, E, M, O, OO, OOO, OOO-S, and R. Each scale results in a value between 0 and 100, with higher values indicating a harder material. Polyurethane is often either discussed as a shore A or shore D durometer. To give some perspective to the reader, a rubber band is typically a shore A durometer of 30, a car tire is shore A 60, a golf ball is shore D 60, and bone is shore D 85. The elastic member 24 has a face surface 26 and in some embodiments the face surface 26 is covered with a friction reducing coating (not shown).

The second die 20 defines a tool holder channel 28 with a tool insert 30 disposed within the tool holder channel 28. The tool insert 30 has a forming edge 32 with a first surface 34, a second surface 36, and a leading edge 38 joining the first and second surfaces 34,36. The leading edge 38 has a radius between 0 and 2 t (two times the thickness of the material being formed). The leading edge 38 radius of the tool insert 30 produces a style line (see 14 in FIG. 4) with a sharper radius when used in conjunction with the elastic member 24.

Figure 3:
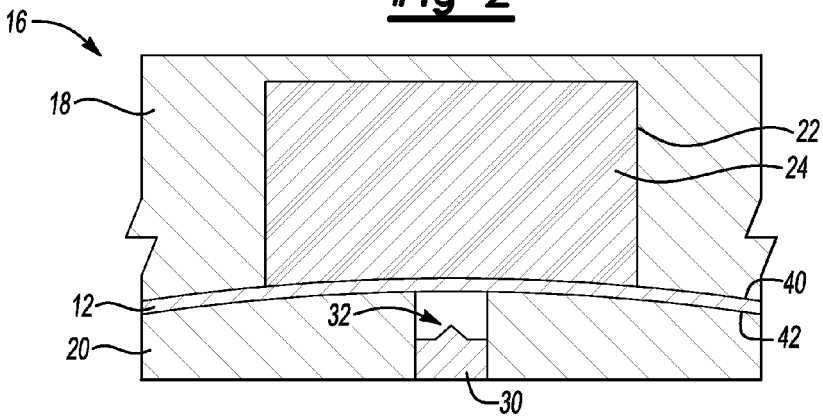
FIG. 3 is a cross-sectional view of the metal panel inserted between the first die that holds the elastic member and the second die that holds the tool insert, and the first die and second die are closed.

Referring to FIG. 3, the die set 16 is shown with the metal panel 12 disposed between the first die 18 and the second die 20 with the dies 18,20 in a closed position. The first die 18 has a first profile surface 40, and the second die 20 has a second profile surface 42, that cooperate to form the metal panel 12 into a shape corresponding to the profile surfaces 40,42. The metal panel 12 is held by the corresponding profile surfaces 40,42, as the die set 16 closes. The corresponding profile surfaces 40,42 may be restrike dies that are not designed to change the shape of a metal panel 12.

In the illustrated embodiment, the tool insert 30 with the forming edge 32 is in a restricted position which does not move relative to the second die 20 and does not form the metal panel 12 as the dies close. The tool insert 30 may advance the forming edge 32 into the metal panel 12 as the dies 18,20 close. The forming edge 32 may also be located on a portion of the profile surface 42 of the second die 20 opposite the elastic member 24 and form the style line 14 as the dies 18,20 close.

Figure 4:
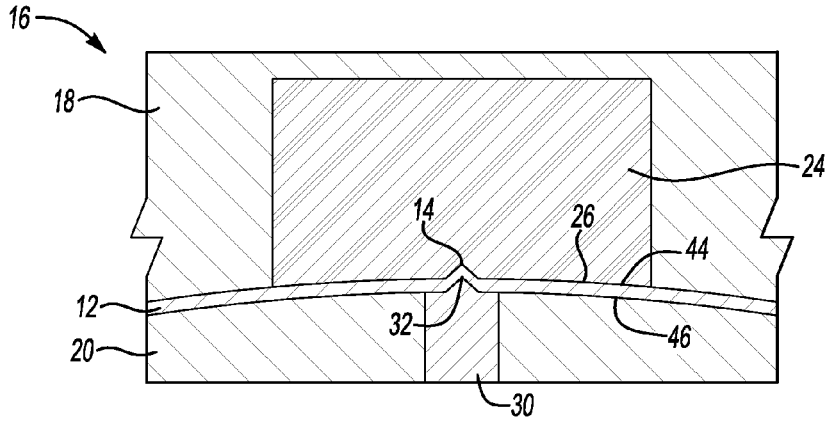
FIG. 4 is a cross-sectional view of the metal panel inserted between the first die that holds the elastic member and the second die that holds the tool insert, with the tool insert pressing the metal panel into the elastic member forming a style line.

Referring to FIG. 4, the die set 16 is shown with the metal panel 12 having a first side 44 and a second side 46 respectively disposed between the first die 18 and the second die 20 with the dies 18,20 in a closed position. The elastic member 24 is shown backing a portion of the first side 44 of the metal panel 12. The tool insert 30 is shown with the forming edge 32 protruding from the second die 20. The forming edge 32 is pressed into a portion of the second side 46 of the metal panel 12 opposite the portion of the first side 44 backed by the elastic member 24 to form the style line 14. The metal panel 12 is impressed with substantially the same shape as the forming edge 32 of the tool insert 30. The metal panel 12 compresses and elastically deforms the elastic member 24 that maintains contact with and stretches at the same rate as a portion of the first side 44 of the metal panel 12 being pressed into the elastic member 24 while the forming edge 32 engages the metal panel 12.

In the illustrated embodiment, the first die 18 and the second die 20 reciprocate in a forming direction to stamp a portion of the metal panel 12. The tool insert 30 reciprocates in a substantially similar forming direction. The tool insert 30 and the forming edge 32 may be designed, however, to move reciprocally in differing directions to that of the dies 18,20. The face surface 26 of the elastic member 24 is disposed substantially orthogonal to the direction that the forming edge 32 moves. The elastic member 24 should be thick enough to allow the material to compress, and provide substantially equalized pressure across a portion of the first side 44 of the metal panel 12 as the style line 12 is formed. The thickness of the elastic member 24 should be at least twice the height of the style line 14 being formed in the metal panel 12 in the forming direction. Different forming directions, differing angles at which components move relative to one another, and different thicknesses of supporting parts may be used.

Figure 5:
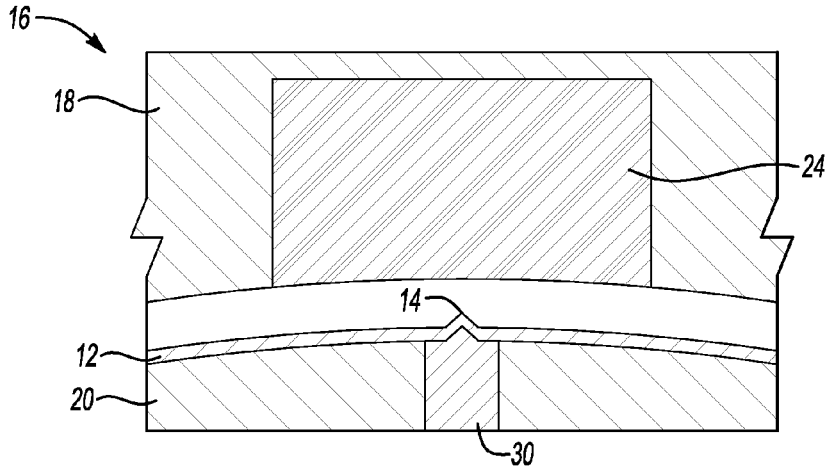
FIG. 5 is a cross-sectional view of the metal panel inserted between the first die that holds the elastic member and the second die that holds the tool insert, with the first die and the second die reopening to return the elastic member to its original dimensions.

Referring to FIG. 5, the die set 16 is shown with the metal panel 12 disposed between the first die 18 and the second die 20 with the dies 18,20 in an open position. The metal panel 12 has been formed to include the style line 14, the tool insert 30 remains pressed into the metal panel 12, and the elastic member 24 has returned to its original shape after the style line 14 was removed. The metal panel 12 is plastically deformed to form the style line 14, and the elastic member 24 returns back to its original shape when the dies 18,20 release.

Figure 6:
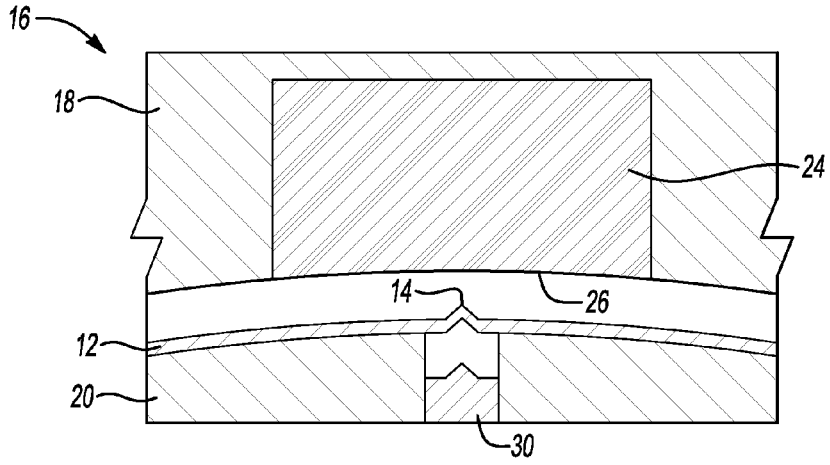
FIG. 6 is a cross-sectional view of the metal panel inserted between the first die that holds the elastic member and the second die that holds the tool insert,with the tool insert refracted from the metal panel.

Referring to FIG. 6, the die set 16 is shown with the metal panel 12 disposed between the first die 18 and the second die 20 with the dies 18,20 in an open position. The tool insert 30 is shown retracted from the metal panel 12, leaving the style line 14 formed in the metal panel 12. The metal panel 12 remains plastically deformed, however, there may be some elastic deformation, or spring back, in the retraction of the metal panel 12 as the tool retracts.

Figure 7:
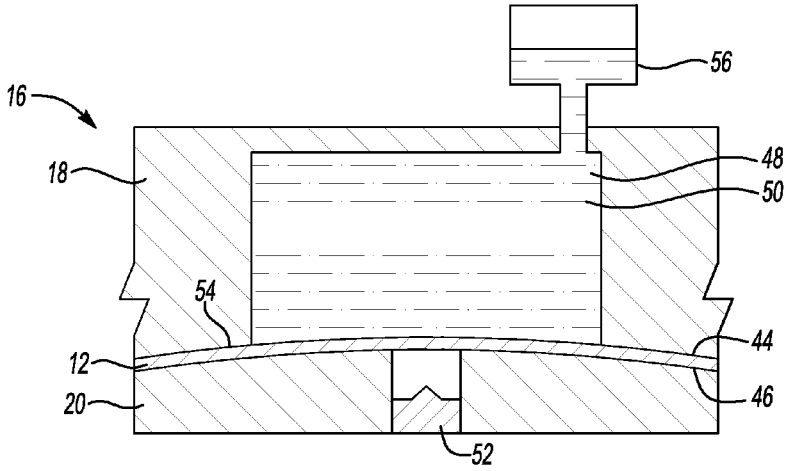
FIG. 7 is the cross-sectional view of the metal panel inserted between the first die that defines a cavity filled with a fluid medium under pressure that cooperates with the metal panel to substantially maintain the pressure in the fluid medium.

Referring to FIG. 7, an alternate embodiment is shown in which the die set 16 utilizes a fluid medium 48 to aid in the forming of the style line (see 14 in FIG. 8) in the metal panel 12. The alternative embodiment backs the portion of the metal panel 12 that the style line (see 14 in FIG. 8) is to be formed with the fluid medium 48 instead of an elastic member (see 24 in FIG. 3). The first side 44 and the second side 46 of the metal panel are disposed between the first die 18 and the second die 20 in a closed position. The first die defines a cavity 50 which contains the fluid medium 48. A forming tool 52 substantially similar to that of a tool insert (see 30 in FIG. 3) is located opposite and aligned with the cavity 50. The forming tool is moveable relative to the metal panel 12.

A sealing surface 54 surrounds the perimeter of the cavity 50 on the first die 18 to contain the fluid medium 48. The sealing surface 54 cooperates with the first surface 44 of the metal panel 12 to substantially maintain the fluid medium 48 within the cavity 50 when the fluid medium 48 is placed under high pressures during the forming of the style line (see 14 in FIG. 8). The fluid medium 48 may be added to, removed from and pressurized while in the cavity 50 by a pumping reservoir 56.

Figure 8:
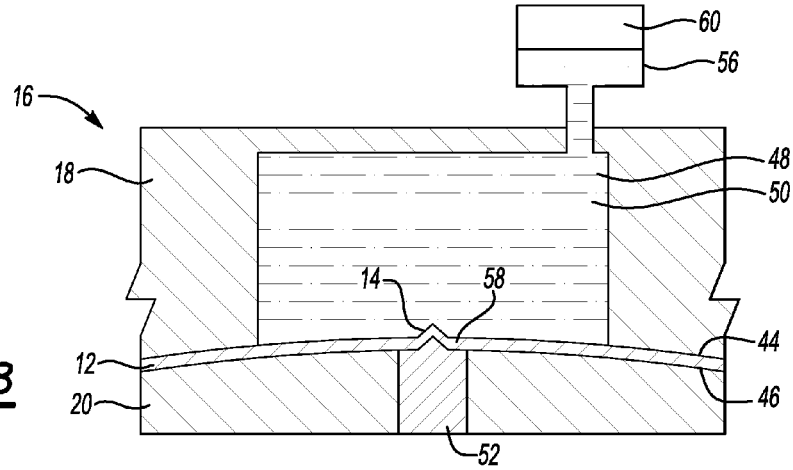
FIG. 8 is a cross-sectional view of the metal panel inserted between the first die that defines the cavity filled with the fluid medium under pressure that cooperates with the metal panel to substantially maintain the fluid medium under pressure while the forming tool presses the metal panel into the fluid medium to form the style line.

Referring to FIG. 8, the die set 16 is shown with the metal panel 12 having the first side 44 and the second side 46 respectively disposed between the first die 18 and the second die 20 with the dies 18,20 in a closed position. The first die 18 defines the cavity 50 which has been filled with the fluid medium 48 from the reservoir 56. The cavity 50 is shown adjacent to a style line area 58 of the metal panel 12. The forming tool 52 has an advancing means, such as, but not limited to, a servomechanism driven by an AC servo motor in cooperation with a ball screw (not shown). The forming tool 52 is advanced and pressed into the second side 46 of the style line area 58 of the metal panel 12. The first side 44 of the style line area 58 of the metal panel 12 is deformed into the cavity 50 displacing the fluid medium 48. The fluid medium 48 is maintained under pressure from a pressure source 60 contained within the pumping reservoir 56. The pressurized fluid medium 48 supports the style line area 58 of the metal panel 12 while forming the style line 14. The style line 14 in the metal panel 12, which has formability properties lower of mild steel, has a sharper radius than a metal panel formed in a traditional hard surface die set (not shown).

The fluid medium 48 is placed under pressure by the pressure source 60 within the reservoir 56. However, pressure could be supplied at any location in fluid connection with the cavity 50. The pressure source 60 is used to maintain a controlled pressure range in the cavity 50, as the fluid medium 48 is displaced by the forming tool 52 pushing the metal panel 12 into the cavity 50. In a preferred embodiment, the pressure source 56 may provide a variable pressure within the cavity 50 while forming the style line 14. A low pressure may be applied to the fluid medium 48 during the initial forming of the style line 14 in the metal panel 12 (as the tool insert 30 presses into the metal panel 12) and then the pressure may be significantly raised raised to form the style line 14 to its final dimensions. Pressure control during the forming of the style line depends on the formability characteristics of the metal panel 12, the thickness of the metal panel 12, and the geometry of the style line 14 being formed in the metal panel 12.

The fluid medium 48 in the cavity 50 is preferably a non-compressible liquid which is backed by a pressure source 60 having a compressible medium in the reservoir 56 that allows displacement of the liquid during the forming of the style line 14. However, the liquid displacement can be controlled in other ways than a pressure source, such as, but not limited to, volumetric control. Alternatively, a compressible fluid may be used in combination with the liquid in the cavity 50 or the entire fluid medium 48 may itself be a compressible fluid.

Figure 9:
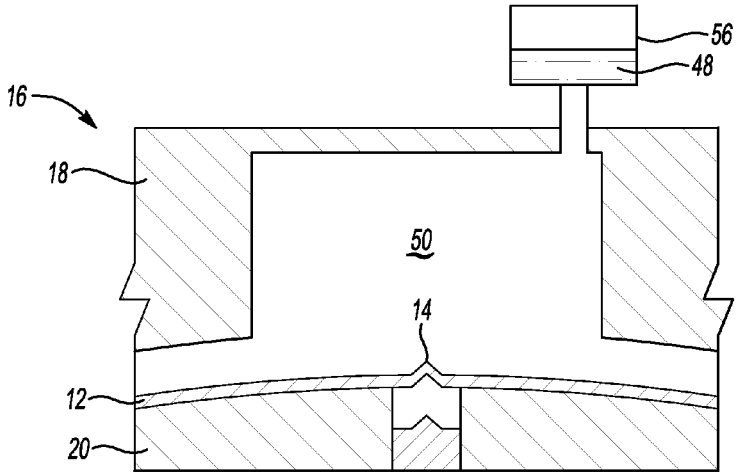
FIG. 9 is a cross-sectional view of the metal panel inserted between the first die and the second die that are in an open position with the metal panel having the style line with a pressure source acting as a reservoir to maintain the fluid medium.

Regarding FIG. 9, the die set 16 is shown with the metal panel 12 disposed between the first die 18 and the second die 20 in an open position. The first die 18 defines the cavity 50 that may be filled with the fluid medium 48 during the forming of a style line 14 in the metal panel 12. The metal panel 12 includes the style line 14, and the pumping reservoir 56 has recaptured some of the fluid medium 48 used to provide pressure to the style line 14 during the forming.

Although several embodiments of the invention are illustrated, it should be apparent to persons skilled in the art that modifications may be made without departing from the scope of the invention. All such modifications and equivalents of the illustrated embodiments thereof are intended to be within the scope of the following claims.

What is claimed is:

1. An apparatus for forming a style line on a metal panel inserted between a first and second die, the apparatus comprising:

a first die having an elastic member and a first profile surface;

a second die having a second profile surface;

a forming edge protruding from the second die; and wherein the profile surfaces hold the metal panel and the forming edge engages the metal panel to form the style line into the elastic member.

2. The apparatus of claim 1, further comprising:

a tool holder channel defined by the second die; and a tool insert disposed within the tool holder channel, wherein the forming edge is provided on a surface of the tool insert.

3. The apparatus of claim 2, wherein the tool insert is moveable relative to the second die.

4. The apparatus of claim 1, wherein the forming edge further comprises:

a first and second surface joined by a leading edge having a radius between 0 and twice the thickness of the metal panel.

5. The apparatus of claim 1, wherein the first die defines an aperture and the elastic member is an insert disposed within the aperture.

6. The apparatus of claim 1, further comprising:

a friction reducing coating disposed between the elastic member and the metal panel to reduce friction while the style line formed in the metal panel elastically deforms the elastic member.

7. The apparatus of claim 1, wherein the first die and the second die are reciprocally moved in a forming direction, and the elastic member has a thickness in the forming direction at least twice the height of the style line in the forming direction.

8. The apparatus of claim 1, wherein the forming edge moves relative to the metal panel and the elastic member has a face surface substantially orthogonal to the direction that the forming edge moves relative to the metal panel.

9. The apparatus of claim 1, wherein the elastic member is polyurethane.

10. The apparatus of claim 1, wherein the elastic member has a 30 to 60 shore D durometer.

11. The apparatus of claim 1, wherein the metal panel has lower formability limits than mild steel.

12. The apparatus of claim 1, wherein the metal panel is an aluminum panel.

13. A method of forming a style line in a metal panel, comprising:

backing a portion of the panel with an elastic polymer;

clamping an adjacent portion of the panel;

advancing a tool with a forming edge into the portion of the panel that is backed by the elastic polymer;

forming the panel with the forming edge to form the style line; and compressing the elastic polymer as the style line is formed.

14. The method of claim 13, wherein during the step of forming the metal panel, one surface of the metal panel is impressed with the same shape as the forming edge of the advancing tool.

15. The method of claim 13, wherein during the forming of the metal panel, the elastic polymer member maintains contact with the metal panel, as the style line forms.

16. The method of claim 13, wherein during the compressing of the elastic polymer member, the elastic polymer member stretches at the same rate as an outer surface of the metal member.

17. An apparatus for forming a style line on a metal panel with a first side and a second side, wherein the metal panel is respectively inserted between a first die and a second die, the apparatus comprising:

a cavity defined by the first die containing a fluid medium, wherein the cavity is adjacent to a forming portion of the first side of the metal panel;

a forming tool held by the second die and aligned with the cavity of the first die, wherein the forming tool is capable of moving relative to the metal panel; and a forming tool advancing means capable of pressing the forming tool into the second side of the metal panel opposite the cavity, pushing the forming portion of the first side of the metal panel into the cavity, displacing the fluid medium, and forming the style line in the metal panel.

18. The apparatus of claim 17, further comprising:

a sealing surface on the first die surrounding a perimeter of the cavity, wherein the sealing surface substantially maintains the fluid medium in cooperation with the metal panel and the cavity.

19. The apparatus of claim 17, further comprising:

a pressure source in fluid connection with the cavity, such that the pressure source may maintain a controlled pressure range in the cavity as the fluid medium is displaced.

20. The apparatus of claim 17, wherein the metal panel used in the process is a metal which has formability limits lower than that of mild steel.

* * * * *